United States Patent [19]

Colley

[11] Patent Number: 4,908,217

[45] Date of Patent: Mar. 13, 1990

[54] APPARATUS FOR MAKING TILES OR SLABS

[75] Inventor: Charles K. Colley, Beaumaris, Great Britain

[73] Assignee: Robert Abraham Limited, Merseyside, England

[21] Appl. No.: 14,051

[22] PCT Filed: Apr. 15, 1986

[86] PCT No.: PCT/GB86/00212

§ 371 Date: Feb. 6, 1987

§ 102(e) Date: Feb. 6, 1987

[87] PCT Pub. No.: WO86/06019

PCT Pub. Date: Oct. 23, 1986

[30] Foreign Application Priority Data

Apr. 18, 1985 [GB] United Kingdom ..... 8509920
Jan. 9, 1986 [GB] United Kingdom ..... 8600455

[51] Int. Cl.[4] ..... B28B 5/02

[52] U.S. Cl. ..... 425/253; 83/326; 198/836; 425/255; 425/315; 425/373; 425/453

[58] Field of Search ..... 425/253, 296, 257, 298, 425/453, 454, 255, 362, 373, 315; 83/14, 326; 198/836; 264/44

[56] References Cited

U.S. PATENT DOCUMENTS

| | | | |
|---|---|---|---|
| 1,355,619 | 10/1920 | Richards | 425/453 |
| 2,315,256 | 3/1943 | Haegele et al. | 83/14 |
| 2,383,736 | 8/1945 | Rembert et al. | 425/253 X |
| 2,562,541 | 7/1951 | Flam | 425/253 X |
| 2,566,787 | 9/1951 | Zevely | 425/253 |
| 3,257,701 | 6/1966 | Lang | 425/253 X |
| 3,396,952 | 8/1968 | Jennrich et al. | 264/44 |
| 3,843,298 | 10/1974 | Rossig | 425/296 |
| 4,211,524 | 7/1980 | Jennrich | 425/296 |

FOREIGN PATENT DOCUMENTS

| | | |
|---|---|---|
| 436844 | 11/1926 | Fed. Rep. of Germany . |
| 2156457 | 6/1973 | France . |
| 562961 | 7/1944 | United Kingdom . |
| 1042454 | 9/1966 | United Kingdom . |
| 1302188 | 1/1973 | United Kingdom . |

*Primary Examiner*—Richard L. Chiesa
*Attorney, Agent, or Firm*—Rogers, Howell & Haferkamp

[57] ABSTRACT

Apparatus for making tiles or slabs such as roofing tiles or paving slabs from castable material, comprises a sequence of platens on an endless conveyor which affords a substantially continuous surface onto which are laid plates and from which dividers are extensible between those plates to sever or at least partially sever a layer of castable material charged and compacted onto the plate. Improvements include selective operation of dividers and their additional provision medially of the platens, selectively operable multiple drill head, charging roller, special plates for tiles to be bent, interlocked drive system.

10 Claims, 2 Drawing Sheets

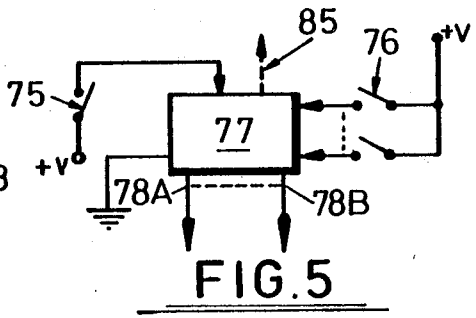
FIG. 5
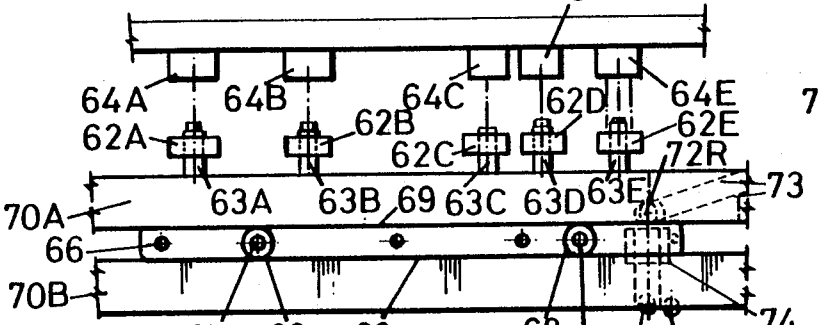
FIG. 4A
FIG. 4B
FIG. 6

APPARATUS FOR MAKING TILES OR SLABS

BACKGROUND OF THE INVENTION

This invention relates to apparatus for making tiles of slabs from castable material particularly concrete.

We have previously proposed such apparatus in relation to making tiles or slabs ranging from roofing tiles to paving slabs, and generally of a type, see our Pat. No. 1302188, where a sequence of platens on an endless conveyor can afford a substantially continuous surface onto which are laid plates and from which dividers are extensible between those plates to sever at least partially a layer of castable (concrete) material charged and compacted onto the plates. Such charging was basically by gravity from a hopper and initial spreading and compaction by associated roller means. Provision was also made for a further charge of finishing material from another hopper and associated spreader roller means with a further compaction stage prior to a drilling stage with positionally adjustable drills necessary for roofing tiles, and a take-off stage for the plates complete with cast and at least partially severed tiles or slabs. That apparatus has proved to be successful over the past fifteen years or so, as have its roofing tile products now well-known by the trade mark HARDROW.

However, that apparatus has certain disadvantages, one of which concerns production of tiles or slabs of different size due to association of the dividers only with leading or trailing edges of the platens, so that platen length has effectively divided one dimension of the tiles or slabs produced, each such divider being raised in turn on a cam track after first compression of the charged and compacted castable material.

The result has been that certain smaller sizes of tiles or slabs have had to be cut down from normal sizes, which involves waste of material.

SUMMARY OF THE INVENTION

According to one aspect of the invention, provision is made for dividers that at least partially sever the charged layer or substrate of suitable material to be operative selectively so as to give a further choice of sizes of tiles or slabs.

That may be achieved particularly advantageously by having more than one divider associated or associatable with each of the platens, whether simply on the basis of at least some dividers being readily removable and replaceable or on the basis of their selective control in sets.

Preferred embodiments hereof specifically involve providing each platen with a medially disposed additional divider, in particular preferred embodiments actually at positions dividing the lengths of two consecutive platens in the ratios 2:1 and 1:2 respectively. Then, if the additional dividers are operable as an alternative to the platen-edge-associated divider between such two consecutive platens, three smaller but equal length tile or slab sizes will be available instead of two larger but equal length sizes. Doing so by selective installation/-removal of dividers is of selfevident flexibility of application. An alternative would be to have two cam tracks each selectively put into its operative configuration and each associated with a different set of dividers, which set may, of course, overlap. These proposals are plainly capable of modification or extension to more medical dividers or producing a mix of tile or slab sizes. Moreover, the same effect is attainable by using smaller platens or a mix of sizes of platens all with edge associated dividers but selectively operable in sets.

The advantages in terms of flexibility of tile or slab size and avoidance of waste will be manifest, perhaps particularly from the expanded possibility arising of making a mix of tile sizes in the same production run.

Another aspect of the invention concerns a drilling stage for the cast, compacted, and at least partially severed, tiles or slabs, which drilling stage comprises an array of selectively operable drill heads disposed in positions corresponding to each possible position for holes required by a range of sizes of tile or slab to be produced, and means responsive to specification of a particular said size in order to select only a particular drill head or heads for operation.

Such arrangement of the drilling stage represents a very substantial improvement on previous use of one or more movable drill heads that had to be set up for position at each change of size for produced tiles or slabs, at least in terms of saving time and giving full compatibility with the desired flexibility of operation and has particular application to operation with an extended range, even mix of, sizes of tiles or slabs.

Other problems include variation of speed of operation and achievement of rates of production now considered to be necessary for commercial viability. For example, at least at higher speeds of operation, the prior apparatus actually worked better with dirty plates, which have substantially increased capability to assist charging by drag to aid withdrawal from the first charging hopper by a first roller, but then, of course, can lead to trouble in terms of disengaging the cast tiles or slabs from the plates.

According to another aspect of this invention, the first or main charging stage includes means for positively discharging castable material, particularly concrete, onto the plates of the conveyor before or into associated compaction means, a suitable positive feed comprises a bladed roller effective to produce a continuous stream of concrete to a position below a compaction roller, preferably similar to the first roller of the prior apparatus, both such rollers conveniently being in the outfeed from a hopper for the concrete.

A particularly preferred positive feed roller has at its blading, a helical formation usually as a rib or fin thereon and then further preferably with a taper of the roller related to the action of the helical blading so as to counteract any tendency differentially to feed material out of the hopper outlet.

A particularly effective such roller uses only light "blading" on a roller that can then be of relatively small diameter, say 40 to 60 mm, compared with what would otherwise be required, and with consequent avoidance of very high bending forces. Typical helical ribbing projects about 5 to 15 millimeters (or grooving of similar indentation), say at a pitch of about 100 to 250 millimeters, on a roller that has a slight taper substantially less than 1 degree, preferably ¼ degree or less, from the end to which the helical blading tends to translate fed material, say tapering of the order of ¼ to 1 millimeters in radius per 100 millimeters length, and with such roller axis canted by a corresponding amount to give a bottom surface substantially parallel with the intended tile surface and a variation of peripheral speed that substantially counteracts translation of fed material along the roller. Such typical values as given herein are, of course, in relation to a specific machine, which uses a single helical blading on a roller of about 50 millimeters diameter and 900 millimeters length, and is subject to variation in accordance with trials and other blading, for example multi-start helical. The principles involved should, however, be apparent.

In terms of maximum speed of operation, the preferred provision for positive feed goes beyond anything achievable by our previous apparatus and, furthermore, permits the use of clean plates, even plates oiled or otherwise treated to promote ready release of cast tiles or slabs, and can achieve a smoother finish to their undersides. Hitherto, use of such plates even at lesser speeds of production give rise to concrete release/-charging of such uneveness as to lead to faulty tiles or slabs, even holes therein. There is, of course, associated compaction of the positively charged concrete, and a much stronger slab or tile can be produced due to the capability of the positive charge/compaction system to work on much less wet concrete mixes. In terms of compaction, there is a further substantial improvement that is essentially independent of speed and can render all further compaction mainly a matter for consolidation of any further "finish" charge into the first or main substrate charge. Such further or secondary charging of another layer onto the main substrate will normally herein also be via positive discharge means for accurate coordination with positive concrete charging whether simply for speed of the latter or for thickness variations therein.

According to a yet further aspect of this invention, provision is made for interlocked control of all driven parts, i.e. the positive feed of the first aspect and its compression roller means, any similar provision for a finish charge, any further compression stage, and operation of the drilling stage, so that variation of overall speed of operation is efficiently and reliably achieved, including any necessary or desirable relative changes of speed of those driven parts.

It is also required to make special bent tiles, e.g. for ridges, hips or valleys, and we further propose herein that casts for such purpose are made thicker through the position of intended bend, and that relevant plates onto which production takes place shall be relatively recessed to give such increased thickness. It will, of course, be appreciated that such plates can be intermixed with normal plates so as to produce a desired mix of normal and special tiles, i.e. additionally and in the same manner as mixing together making of different sizes of normal tiles by suitable ordering of relevant plates and operation, usually presence/absence, of appropriate dividers in a coordinated manner.

It will be appreciated that the various aspects of this invention contribute to overcoming the above-mentioned problems and generally contribute features of importance to satisfactory achievement of apparatus capable of reasonable production rates with a high degree of flexibility of operation and ease of adjustment.

BRIEF DESCRIPTION OF THE DRAWINGS

Embodiments of the invention will now be described, by way of example, with reference to the accompanying schematic drawings, in which:

FIGS. 4A and 4B are side and end elevations of drilling gear;

FIG. 5 is a block electrical circuit diagram for drill control;

FIG. 6 is a block electrical circuit diagram for speed control;

DETAILED DESCRIPTION OF THE PREFERRED EMBODIMENTS

Figures 1, 1A, 2, 3A, 3B, 7, 8:
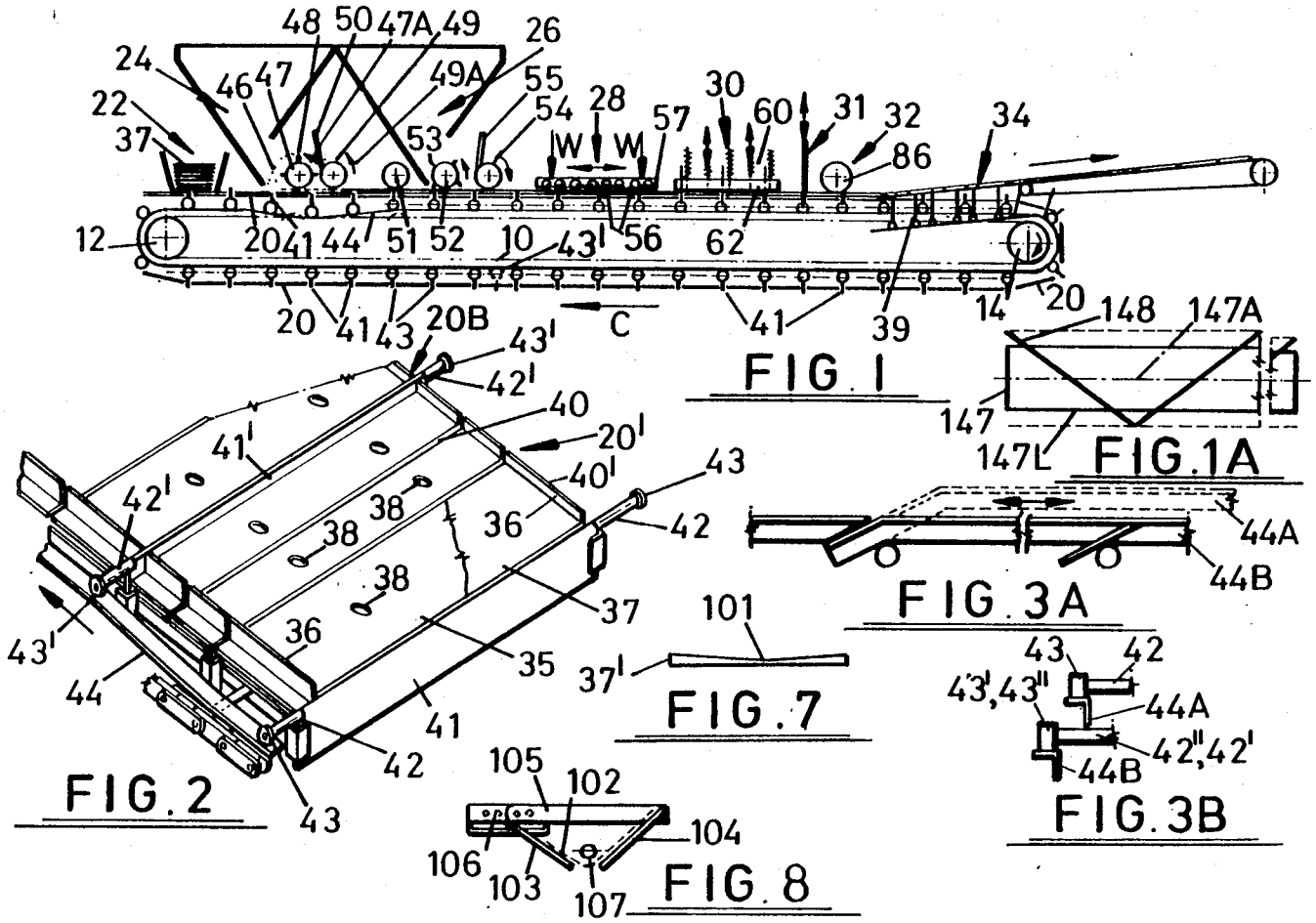
FIG. 1 is a side elevation of a machine.
FIG. 1A is a broken diagrammatic elevation of a preferred concrete feed roller.
FIG. 2 is a perspective partial view of consecutive platens and associated divider-operating cam track.
FIGS. 3A and 3B are side and transverse views of selective operable cam-tracks.
FIG. 7 shows a variant support plate for tiles or slabs to be bent.
FIG. 8 shows a preferred way to bend tiles or slabs.

In FIG. 1, the tile or slab making machine has an endless conveyor 10 running about horizontally spaced drive/guide rollers 12, 14. The endless conveyor 10 travels in the direction C when driven and carries a plurality of platens 20 in end-to-end succession so that same will traverse upper and lower runs of the conveyor 10 and go about its end rollers 12, 14. On the upper run, the platens 20 go through successive stations for plate dispensing (22), concrete charging (24), finish layer charging (26), consolidation (28), drilling (30), cutting (32), and charged plate removal (34). In general, that is, of course, the basic arrangement described in our above-mentioned Pat. No. 1302188.

As before, bases 35 of the platens 20 have upstanding sides 36 (see FIG. 2) but no ends so that concrete charged at 24 will be in a continuous layer from platen to platen, actually on plates 37 deposited on the platen at 22 and covering holes 38 in the platen bases 35 through which ejection-aiding plungers 39 are operable at the removal station 34. Also, spaces 40 are shown for divider plates 41 between successive platens 20, and the divider plates are shown with extensions 42 at each side that carry rollers 43 for operation by a cam-track 44 in raising and lowering the divider plates 41. In their lowered position, the tops of the divider plates 41 do not obtrude above the charging plates 37, and may be substantially level with the platens 20. If slightly higher, that can assist automatic plate dispensing at 22 by cooperation with a forward step or restriction thereat to force plates 37 to go only between tops of the divider plates 41 protruding above the bases 35 of the platens themselves. Alternatively, and preferably, dispensing of the plates 37 is triggered by trips operated by the side extensions 42 of the divider plates 41.

The concrete charging station 24 is in the form of a hopper having at its exit 46 a positive discharge means in the form of a roller 47 equipped with suitable blading 48 and rotated in the direction of the arrow 47A. A helix of appropriate pitch is suitable for the blading 48, see 148 in FIG. 1A for roller 147.

There, the helical blading is an upstanding rib 148 extending about 6.5 mm above the roller surface and with a pitch of about 150 mm. The roller itself has a slight taper, actually about 3 mm radius reduction in a roller length of 900 mm, and has a corresponding cant of the drive axis 147A so that its lower surface 147L is substantially parallel with the platen surface, i.e. also with the intended concrete surface. Quite a small diameter roller can be used, for example 40 mm to 60 mm for FIG. 2. The larger end of the roller 147 is at the side of the machine to which its slight tendency to translate fed concrete is operative thereby to present progressive increase of peripheral speed to take fed concrete away without unwanted build-up at that end, and without interference to smooth and regular flow.

At least for dry fed material, e.g. finishing sand, or where there is cleaning provision for the feed roller, an helical groove or grooves could be used instead of projecting blading (rib). A smooth positive flow of concrete onto the plates 37 is assured by the bladed roller 147 whose speed can be varied according to the desired or prescribed rate of production for the machine and in a manner suitably interlocked with the speed at which the conveyor 10 is driven.

After the positive feed roller 47 is a compacting roller 49 also rotated in the direction of the arrow 49A and serving to exert a prescribed downward pressure on the concrete so as to produce a suitably strong, homogeneous, compacted tile of slab substrate. A doctor blade 50 is shown associated with the compacting roller 49 to clean excess concrete therefrom. Another similarly rotating roller 51 thereafter is operative both to further condition the surface of the compacted charged concrete substrate and to serve as an abutment for the divider plates 41 which are lifted successively by the cam-tracks 44 to their raised position against the roller 51 to sever the concrete substrate between the plates 37. It is not necessary for the divider plates 41 actually to reach the surface of the roller 51, so long as the division made is readily finally broken, say at 31 in FIG. 1 by a transverse cutter blade.

FIG. 1 shows, diagrammatically, only divider plates 41 between the platens 20. However, as will be seen from FIG. 2, the platens 20 actually have provision for intermediate divider plates, see slot or space 40' and divider plate 41' with associated side extensions 42'carrying wheels or rollers 43'. The slots or spaces 40', as shown, divide consecutive platens 20A, 20B in the ratios 2:1 and 1:2 in the direction of travel of the conveyor 10, thereby enabling manufacture of slabs or tiles of two or three different equal lengths by selective operation of the divider plates 41, 41', and loading of correspondingly sized charging plates 37. That selection is conveniently done by appropriate removal/emplacement of divider plates 41, 41', which enables use always of the same cam-tracks 44 to each side of the conveyor 10. An alternative would be for there to be two cam-tracks 44A and 44B at each side of the conveyor 10, see FIGS. 3A and 3B, and for each cam-track itself to be selectively enabled. To that end, rollers 43 on every divider plate 41 between platens engage one cam-track 44A and rollers 43' on every intermediate divider plate 41' engage on the other cam-track 44B. It will be appreciated that alternate ones of the divider plates 41 also have further rollers 43'' engaging the cam-track 44B. The rollers 43 and 43', 43'', respectively, and the corresponding cam-tracks 44A, 44B will be at different spacings and/or heights relative to sides of the conveyor 10. Selective cam-track selection is indicated by alternative full lines and dashed lines in FIG. 3A with means for achieving same by pushing/pulling part thereof having inclined parts cooperating with rollers.

The secondary charging station 26 for any desired finish or facing layer, such as sand, is shown as another hopper in the same system as the concrete charging hopper, but could by physically separate if desired. That secondary charging station 26 is also preferably provided with positive discharge means again shown as a rotating roller 52 with suitable blading 53, and is further associated with a counter-rotating roller 54 that will skid on the surface of the concrete to assure even distribution of sand thereon. A doctor blade 55 is shown associated with the spreading roller 54.

Thereafter, the finish or facing layer is consolidated with the concrete substrate by a series of rollers 56 bearing thereon at station 28 in a carriage 57 that is reciprocated to-and-fro in the direction of travel of the conveyor 10. Downward pressure is required of the carriage 57 and rollers 56 for consolidation purposes, but need not be as great as was required hitherto. The rollers 56 will bear on the concrete via an elastomeric compression sheet, which can apply a particular pattern if same if required to be imposed on the finished or faced surface.

The next stage is the drilling stage 30 where holes are made in the slabs or tiles at positions appropriate to their size and type. A plurality of drills 60 are shown, one for each possible position of several sizes and types of tile or slab, preferably corresponding to all normal production options for the machine. The drills 60 are each indicated as spring biassed, see 61 in FIG. 4B, for cushioned engagement with the plates 37. The drills 60 are carried on drill frames 62 themselves movable down pillars 63 by actuator 64 against spring bias 65. Except when operated by actuators 64, the drill frames 62 and drills 60 are returned from their drilling positions. The actuators 64 may comprise pneumatic rams one each for plural drill frames 62, see subscripts A–E. If desired, depression of the drills may be accompanied by application of a turning drive say be selectively operable air motors. Additionally or alternatively one or more frames like 62 may carry cutting blades, for example that shown at 31 in FIG. 1.

The pillars 63 are shown extending upwardly from sides of a main frame 66 that is reciprocable in the direction of the conveyor 10, as shown by trunions 67 and rollers 68 relative to tracks 69 between beams 70A, 70B at both sides of the overall machine frame. In operation, the main frame 66 is picked up by each divider plate 41, 41' in turn, conveniently by their extensions 42, 42' or, as shown, their wheels or rollers 43, 43' via contact with wheel or wheels 71 on a pick-up arm or arms 72. At its other end, such arm 72 has a wheel or roller 72R in a rising track 73 on the machine frame, see at 70A, so as to raise that arm 72 through a block or guide 74 on the main frame 66 as the latter is moved in the direction of the conveyor 10 until roller/wheel engagement at 71, 72 is lost, whereupon the main frame 66 is automatically returned by means not shown and is then ready to be pushed up by the next divider plate 41, 41'.

During its upward movement the pick-up arm 72 will operate a microswitch in the block or guide 74 serving to operate one or more of the actuators 64. The microswitch, see 75 in FIG. 5, may be interlocked with tile type-specifying means, such as further switches 76 via suitable interconnections or logic at 77 to determine an appropriate one or more of the actuators 64 for operation over lines 78A–78E.

When operated, any drill frame 62 descends to push its drills 60 into the cast tiles or slabs below it. Those drills 60 are shown guided through holes in an angle member 80 itself supported at 81 on posts 82 slidable through the drill frame 62 against spring loading 83 affording further cushioning relative to the cast tiles or slabs and thus further facilitating operation relative to a variety of thicknesses thereof. Undersides of the angle members 80 have pierced drill pads 84 that first engage the tiles or slabs. It will be appreciated that such an angle member or members 80 could alternatively, even additionally, carry cutting blades (not shown) and serve simply a transverse cutting function if without drills 60, and same may be controlled along with the drill frames 64 from extension of the circuitry 77 of FIG. 5, see dashed at 85.

As will be clear, machines hereof most conveniently make pluralities of slabs or tiles side-by-side actually charged in one homogeneous layer that is first divided transversely of the conveyor 10 by the divider plates 41, 41', if necessary completed at 31 or within the drilling station 30, and then slit in the other direction by blades 86 at the station 32. Accordingly, the pneumatic rams 64 will operate corresponding sets of the drills 60 via frames 62 according to selection of tile type or size. If desired, of course, some of the drills 60 may be individually associated with controlled latches, or alternative frames 62 fitted simply over the pillars 63.

Pneumatic rams are preferred for operating the drills 60, at least partly because pressure is preferably applied wherever necessary throughout the machine by pneumatic means as it is inherently less "hard" than hydraulics or mechanical means unaccompanied by "soft" absorbers etc.

Turning to FIG. 6, one practical arrangement is shown for controlling the various drives of the machine of FIG. 1. Individual motors are used for various parts and are given the same reference as the parts they drive, but subscripted M. Each motor is shown with an individual potentiometer type control, subscripted P, for basic setting up and fine tuning of the machine, and conveniently available from well-known A.C. starter control units. A basic requirement at set-up is for the take-off conveyor at station 34 to run slightly faster than the main conveyor 10. Afterwards, however, speed setting will normally require proportionate changes at each of the controlled motors, see controller 90, which may be of A.C. inverter type, and dashed connection 91 to all motor control potentiometers.

It will be noted that the main charge spreading and compression plain roller 49 and the cutting abutment roller 51 are shown sharing a common drive, which is normally convenient. It is, in fact, normally also convenient for the finish material charge roller 52 and the counter-rotating roller 54 also to share the same drive motor, hence sharing 54M etc. dashed in FIG. 6. The consolidation roller motor control is also shown dashed in FIG. 6 as its resilient membrane is actually moved by the cast tiles or slabs and applied downward pressure on the frame 57 and a constant rate of movement of its rollers 56 may well be tolerable.

Additionally, FIG. 6 shows circuitry 92 responsive to type selection for applying individual variation at least to the finish material charging control 49, 51P, the main speed control 90 to take account of overall constraints that may apply for particular types, and for the main charging roller 47. The latter is shown via thickness control circuitry 93 which it may be useful to have individually variable (shown conventionally). Additional connection is shown to the consolidation roller stage 28 as same may be applicable to using different resilient membranes say for pattern effects.

Special bent tiles, e.g. for ridges, hips or valleys, are readily made on the same machine, but preferably via special plates 37', see FIG. 7, that are made of medially reduced thickness, see 101, so that the tile produced is of greater thickness medially. Actual bending can be done from the plate-side of the tile by dropping the finished side onto a sheet or flexible material, for which hessian will serve. Such flexible material, see 102 in FIG. 8, is, advantageously according hereto, on two boards 103, 104 hinged to a tie 105 that limits the relative angular position attainable by the boards, preferably adjustably via preset pin holes 106. The boards can be flat at placement of the tile or slab on the hessian and moved to the desired position during rolling (107) of the tile over its thickened part.

I claim:

1. Apparatus for making tiles or slabs such as roofing tiles and paving tiles from castable material, comprising an endless conveyor, a sequence of platens on the endless conveyor forming a substantially continuous surface, a series of plates on the substantially continuous surface, and dividers extensible between adjacent plates to at least partially sever a layer of castable material charged and compacted onto the plates, and further comprising a charging stage for said castable material, the charging stage comprising means for positively discharging the castable material onto the plates on the conveyor and compaction means for bearing down on such positively discharged castable material, and wherein means for discharging castable material comprises a helically bladed roller and a pressure roller, the bladed roller being tapered and indented and having a canted axis to as to be effective to produce a continuous substantially even stream of castable material to a position below the pressure roller.

2. Apparatus according to claim 1, including a hopper for containing and discharging the castable material through a discharge outlet, both said rollers being located in the discharge outlet, and interlocked drivers for the rollers.

3. Apparatus according to claim 1 wherein the dividers may be selectively fixed at predetermined relative distance apart from each other so that tiles or slabs of selective size defined by the distance between the dividers may be produced.

4. Apparatus as set forth in claim 3 including means for selectively positioning said dividers above a space between adjacent platens or above a medial portion of a platen.

5. Apparatus according to claim 3, wherein said positioning means locates the dividers at positions that establish the lengths of two consecutive platens in the ratio of 2 to 1.

6. Apparatus according to claim 1, further comprising a drill stage for cast, compacted, and at least partially served tiles or slabs, the drilling stage comprising an array of selectively operable drill heads disposed in positions corresponding to each possible position for holes required by a range of sizes of tiles and slabs to be produced, and means responsive to specification of a particular said size in order for selecting which drill head or heads will operate.

7. Apparatus according to claim 1, including interlocked control means, means for connecting the interlocked control means to substantially all driven parts of the apparatus so that the variation of overall speed of operation of said driven parts is efficiently and reliably achieved.

8. Apparatus according to claim 1, including recessed plates for special bent tiles, the recessed plates incorporating means for creating a thicker cast area or a bent area of a tile.

9. An apparatus for making tiles or slabs such as roofing tiles and paving tiles from castable material, comprising:

an endless conveyor means;

a sequence of platens on the endless conveyor means forming a substantially continuous surface with a slot separating adjacent platens, the platens having first and second lengths;

a series of plates on the substantially continuous surface;

a plurality of dividers manually removed from and emplaced in selected slots, and automatically retracted into and extended from the selected slots between adjacent plates to at least partially sever a layer of castable material charged and compacted on the plates, the dividers being selectively manually positioned in slots at first predetermined distances from each other and selectively manually positioned in slots at second predetermined distances from each other enabling the apparatus to produce tiles or slabs of two different lengths;

first and second track means extending along a length of the conveyor means;

the plurality of dividers comprising a first and second set of dividers having first and second abutment means respectively, the first abutment means engaging with the first track means and the second abutment means engaging with the second track means, wherein the elevation profile on the first track means causes the first set of dividers to be automatically retracted into and extended from selected slots and the elevation profile of the second track means causes the second set of dividers to be automatically retracted into and extended from selected slots.

10. The apparatus of claim 9 comprising:

the first set of dividers being manually emplaced in selected slots at the first predetermined distance from each other; and the second set of dividers being manually emplaced in selected slots at the second predetermined distance from each other.

* * * * *